US006068383A

United States Patent [19]

Robertson et al.

[11] Patent Number: 6,068,383

[45] Date of Patent: May 30, 2000

[54] PHOSPHOROUS FLUORESCENT LIGHT ASSEMBLY EXCITED BY LIGHT EMITTING DIODES

[76] Inventors: Roger Robertson, 4569 W. H/W 86, Joplin, Mo. 64804; Mark Williams, 10345 County Rd. 130, Carthage, Mo. 64836; Paul Eckels, 811 Rustic Ridge; Peter Weller, 3201 Sunset Dr., both of Joplin, Mo. 64804; Danny Lambeth, 2426 W. Sequoia La., Carthage, Mo. 64836; Randy Pyrtle, 3320 Texas Ave. 204A, Joplin, Mo. 64804; Randy Backler, 2139 Forest Dr., Carthage, Mo. 64836

[21] Appl. No.: 09/033,430

[22] Filed: Mar. 2, 1998

[51] Int. Cl.[7] ..... F21V 9/16

[52] U.S. Cl. ..... 362/84; 362/230; 362/242; 362/260; 362/293; 362/800; 250/461.1

[58] Field of Search ..... 250/461.1; 40/542, 40/543, 544; 362/84, 230, 235, 240, 242, 260, 293, 800

[56] References Cited

U.S. PATENT DOCUMENTS

| | | | |
|---|---|---|---|
| 3,596,095 | 7/1971 | Leach | 250/461.1 |
| 4,744,012 | 5/1988 | Bergkvist | 40/543 |
| 4,779,166 | 10/1988 | Tanaka et al. | 362/84 |
| 4,903,172 | 2/1990 | Schoniger et al. | 362/84 |
| 5,029,046 | 7/1991 | Kameda | 362/84 |
| 5,253,150 | 10/1993 | Vanni | 362/84 |
| 5,299,109 | 3/1994 | Grondal | 362/260 |
| 5,813,753 | 9/1998 | Vriens et al. | 362/293 |

*Primary Examiner*—Alan Cariaso

[57] ABSTRACT

The present invention incorporates a series of light emitting diodes which transmit an ultra-violet region of the electromagnetic spectrum to a bed of phosphorous to provide a fluorescent light source.

3 Claims, 1 Drawing Sheet

PHOSPHOROUS FLUORESCENT LIGHT ASSEMBLY EXCITED BY LIGHT EMITTING DIODES

BACKGROUND OF THE INVENTION (1) Field of the Invention

The invention relates to the field of fluorescent lighting which is excited by light emitting diodes.

(2) Description of the Prior Art

Early artificial lighting technology has utilized a metal filament, such as tungsten contained within an enclosed glass tube upon which a vacuum is drawn. An electric current is passed across the filament and the metal begins to glow white hot due to the resistance of the tungsten to the flowing electrons in the electric current. This concept results in an extremely low energy conversion rate of electricity utilized to provide visible light because of the large heat losses and relatively short life span of the tungsten filament. Nevertheless, this incandescent light technology has been commercially successful for quite some time.

In the late 1930's, fluorescent light technology resulted in considerable energy savings over that required in incandescent systems. The typical fluorescent lamp is an electrical discharge device which utilizes a low-pressure mercury vapor arc to generate an ultra-violet energy source. This energy is absorbed by a coating of phosphorous on the inside of a glass tube and the phosphor converts the ultra-violet energy to a visible wavelength of a particular color. The process by which phosphor absorbs the ultra-violet radiation and de-excites by admitting visible radiation is commonly referred to as fluorescence. The wavelengths of the generated light are determined by the composition of the phosphor, and such composition and phosphor determination and calculation to obtain the desired wavelength and, in turn, the achieved light color, are well known to those skilled in the art and is not part of this invention, per se. For example, the phosphor may be a fluoride of lanthanum, gadolinium or yttrium activated by erbium or thulium and sensitized by either ytterbium. These phosphors have an excitation spectrum extending from approximately 9000 to 10,400 A. Oxy sulfides of lanthanum gadolinium or yttrium and activated by erbium or thulium and thereafter sensitized by ytterbium also may he utilized. The phosphor may be coated onto the transparent, preferably glass, enclosure portion of the lighting assembly in a number of ways. It may be suspended in a suitable binder and painted onto the surface or phosphor crystals may be grown on such surface for ultimate contact with the light emitting diode crystals and the crystals may be ground and polished on one face and cemented together with transparent cement, or the like.

There are many advantages and disadvantages to mercury-based fluorescent lighting. First, the advantages include better lumen efficacy than incandescent lighting and an expected average life span in excess of 10 to 20 times. Thus, fluorescent technology decreases the number of lamps utilized for a given time period and the labor associated with replacing the incandescent bulb. Conversely, the disadvantages of fluorescent lighting include less than ideal energy conversion to light (only about 23% of the total lamp wattage in a standard fluorescent lamp is actually transformed into visible light), the need for heavy and costly electrical componentry to start and regulate the arc within the lamp, and the presence of mercury and rare earth gases (usually argon, krypton, neon, or a mixture of these) at lamp disposal which are potentially environmentally damaging.

Applicant is aware of the following prior art patents which generally relate to the subject matter of the present invention:

| U.S. Pat. No. | Patentee |
|---|---|
| 3,529,200 | Potter et al |
| 3,591,941 | Jaffe |
| 3,593,055 | Geusic et al |
| 3,659,136 | Grodkiewicz |
| 3,774,086 | Vincent |
| 4,035,686 | Fleming |
| 4,385,343 | Plumly |
| 4,473,834 | Soclof |
| 4,847,508 | Kokubu |
| 5,020,252 | De Boef |
| 5,251,392 | McManigal |
| 5,276,591 | Hagerty |
| 5,365,411 | Rycroft |
| 5,452,190 | Priesemuth |
| 5,640,792 | Smith et al |
| 5,653,523 | Roberts |

The present invention is directed to overcoming the problems associated with the prior art, as described above.

SUMMARY OF THE INVENTION

The present invention provides a lighting assembly having a housing. A source of electric power is transmitted exteriorally to within the housing. A series of light emitting diodes are mounted within the housing and sufficient in output wavelength for excitation of phosphorous receptive to an ultra-violet region of the electromagnetic spectrum. Electric power transforming means are provided to convert the electric power into a known voltage for use by the light emitting diodes. A light emitting transparent surface having an interior surface area is provided and which may form a part of the housing. A coating of ultra-violet excitable phosphorous material is placed on the glass and interior of the housing whereby when the phosphorous coating is excited by light emitted from the diodes, a light spectrum visible to the naked eye is produced through the transparent surface.

BRIEF DESCRIPTION OF THE DRAWING

The single drawing.

DESCRIPTION OF THE PREFERRED EMBODIMENTS

Figure 1:
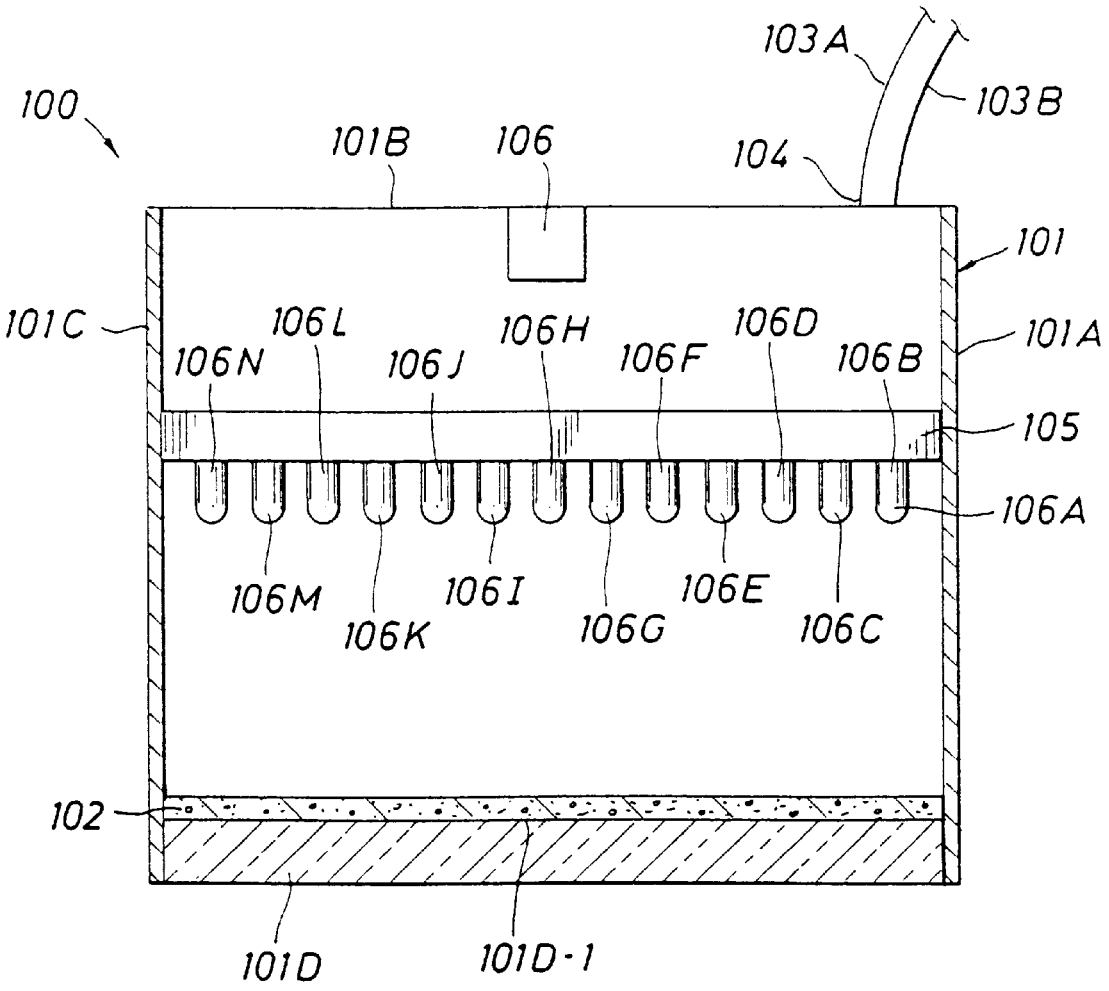
FIG. 1, is a schematic, horizontal cross-sectional view of the lighting assembly of the present invention.

Now, with reference to FIG. 1, there is shown the lighting assembly 100 of the present invention. The assembly 100 consists of an outer housing 101 having parallel vertically extending side wall members 101*a* and 101*c* intersecting a flat vertical upper surface or wall 101*b* which, in turn, has an opening 104 therethrough for receipt of conventional electric lines 103*a* and 103*b* extending to a source of electric power (not shown). The electric lines 103*a*, 103*b* extend to a transformer 106 for transforming the electric current into known and readily calculable voltage for use with the light emitting diodes of the present invention.

The housing 101 also has a lowerly facing horizontal second end 101*d* terminating at each end by the respective vertical housing side members 101*a*, 101*c*. A light emitting face 101*d* oriented in one or more directions to direct a beam or beams of light visible to the naked eye typically would be transparent or, alternatively, may be tinted or colored, and is made of glass, plastic or other smooth surface having an inwardly facing smooth surface 101*d–l* upon which the phosphor is placed to provide the coating 102. "Transparent" as used herein contemplates a range of faces from fully transparent to shaded, tinted or colored, it being understood that the amount of transparency is selective, depending upon the quantum of light spectrum required to be delivered through and by the assembly.

Immediate the interior of the housing 101 between the upper end 101*b* and the glass 101*d–l* is a subhousing member 105 securely extending between the parallel side members 101*a*, 101*c*. The subhousing 105 secures a series of aligned individual ultra-violet emitting light emitting diodes clusterly mounted thereon and identified in FIG. 1 as 106*a*, 106*b*, 106*c*, 106*d*, 106*e*, 106*f*, 106*g*, 106*h*, 106*i*, 106*j*, 106*k*, 106*l*, and 106*m*. One or more subhousings 105 may be provided with accompanying LEDs as the case and the necessity dictate.

The LEDs preferably incorporable within the present invention are made by the Nichia America Corporation and emit radiation into the ultra-violet region of the electromagnetic spectrum. The preferred InGaN diode will have a peak intensity wavelength of about 371 nm and about an 8.6 nm full width half maximum dispersion with an output within 6 nm of one of the secondary ultra-violet output peeks of a mercury arc found in current or traditional fluorescent lighting. It is believed that the life span of this type of diode is in excess of about 100,000 hours and will provide satisfactory luminescence upon the phosphorous coating of the glass or other smooth surface.

The type of phosphorous selected for use in the present invention and the coating and the means used to coat the transparent surface are well within the skill of artisans in the field of fluorescent lighting.

It is well known that ultra-violet radio frequency radiation may be harmful to humans, and it will be appreciated that conventional radiation protection should be provided by means of adequate housing components. Furthermore, it will be appreciated that the present invention provides a light source the intensity of which may easily be accomplished by provision of a rheostat circuit, as opposed to complicated ballasting and controls which are frequently required for prior art fluorescent lighting systems. Moreover, since light emitting diodes are highly efficient, low voltage devices, solar and other energy sources are easily adapted for incorporation as the electrical energy source for use with the present invention, as well as direct current battery backup systems.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly modifications are contemplated which can be made without departing from the spirit of the described invention.

What is claimed and desired to be secured by Letters Patent is:

1. A lighting assembly comprising:

(1) a housing;

(2) a source of electric power transmitted within the housing;

(3) a series of light emitting diodes mounted within said housing and sufficient in output wavelength for excitation of phosphorous receptive to an ultra-violet region of the electromagnetic spectrum;

(4) transforming means to convert power into a known voltage for use by a plurality of said light emitting diodes;

(5) a light emitting transparent surface having an interior surface area; and (6) a coating of ultra-violet excitable phosphorous and placed on the interior surface area of said transparent enclosure, whereby when said phosphorous coating is excited by light emitted from said diodes, a light spectrum visible to the naked eye is produced by said coating and through the transparent surface.

2. The assembly of claim 1 wherein each diode has a peak intensity wavelength of 371 nm and a full width at ½ maximum dispersion of about 8.6.

3. The assembly of claim 1 wherein each diode output is no less than about 6 nm of a secondary ultra-violet output peak of a fluorescent mercury arch.

* * * * *

US006068383C1

(12) EX PARTE REEXAMINATION CERTIFICATE (9237th)

United States Patent
Robertson et al.

(10) Number: US 6,068,383 C1
(45) Certificate Issued: Aug. 28, 2012

(54) PHOSPHOROUS FLUORESCENT LIGHT ASSEMBLY EXCITED BY LIGHT EMITTING DIODES

(75) Inventors: Roger Robertson, Joplin, MO (US); Mark Williams, Carthage, MO (US); Paul Eckels, Joplin, MO (US); Peter Weller, Joplin, MO (US); Danny Lambeth, Carthage, MO (US); Randy Pyrtle, Joplin, MO (US); Randy Backler, Carthage, MI (US)

(73) Assignee: H.E. Williams, Inc., Carthage, MO (US)

Reexamination Request:
No. 90/011,549, Mar. 7, 2011

Reexamination Certificate for:

| | |
|---|---|
| Patent No.: | **6,068,383** |
| Issued: | **May 30, 2000** |
| Appl. No.: | **09/033,430** |
| Filed: | **Mar. 2, 1998** |

(51) Int. Cl.
*F21V 9/00* (2006.01)

(52) U.S. Cl. ..... 362/84; 362/230; 362/260; 362/293; 362/800; 362/242; 250/461.1

(58) Field of Classification Search ..... 362/84
See application file for complete search history.

(56) References Cited

To view the complete listing of prior art documents cited during the proceeding for Reexamination Control Number 90/011,549, please refer to the USPTO's public Patent Application Information Retrieval (PAIR) system under the Display References tab.

*Primary Examiner*—Cameron Saadat

(57) ABSTRACT

The present invention incorporates a series of light emitting diodes which transmit an ultra-violet region of the electromagnetic spectrum to a bed of phosphorous to provide a fluorescent light source.

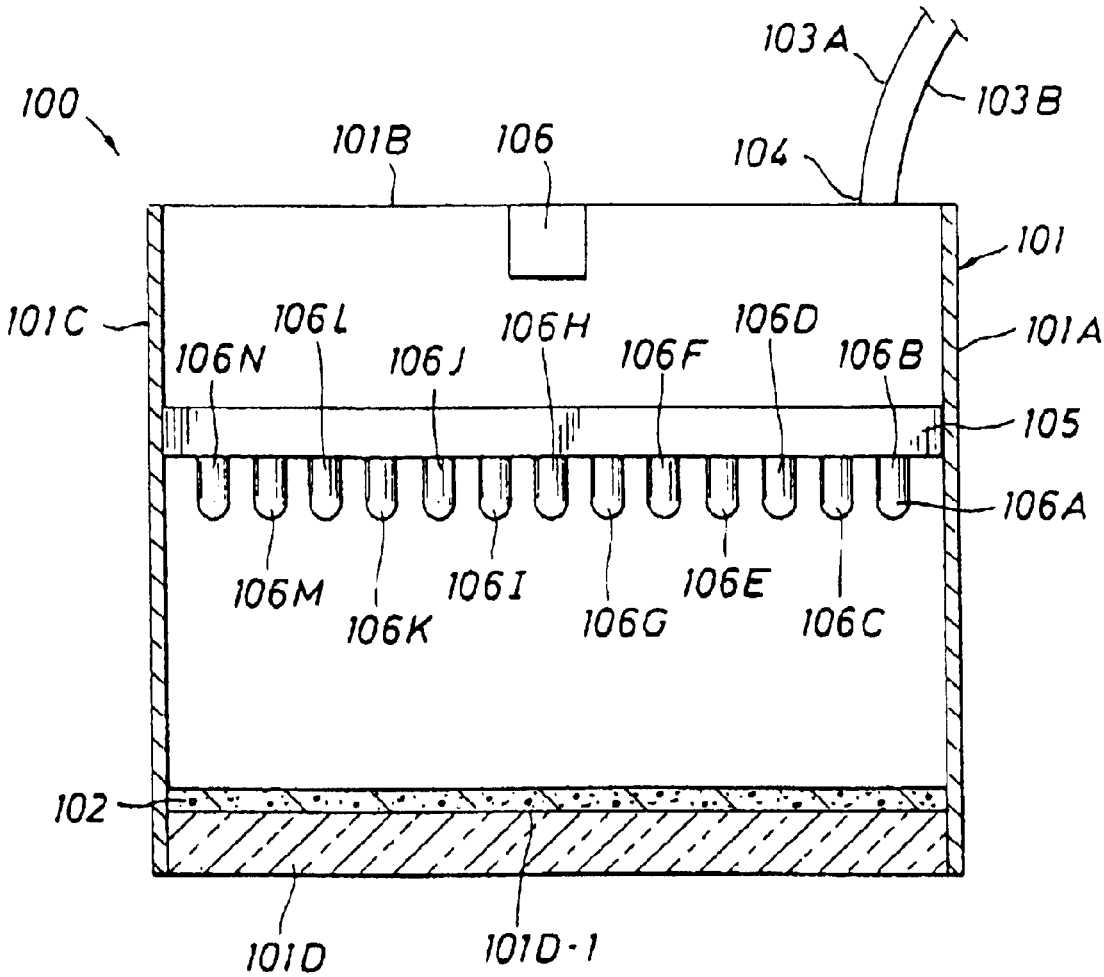

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-3 are cancelled.

* * * * *